US010773861B2

(12) United States Patent
Caswell et al.

(10) Patent No.: US 10,773,861 B2
(45) Date of Patent: Sep. 15, 2020

(54) STORAGE CONTAINER LID SYSTEM WITH ATTACHMENT DEVICE

(71) Applicant: Enhance Product Development, Inc., Minneapolis, MN (US)

(72) Inventors: Ty Joseph Caswell, Zimmerman, MN (US); Trevor Lambert, Brooklyn Park, MN (US); Jason Koss, Minneapolis, MN (US)

(73) Assignee: ENHANCE PRODUCT DEVELOPMENT, INC, Minneapolis, MN (US)

( * ) Notice: Subject to any disclaimer, the term of this patent is extended or adjusted under 35 U.S.C. 154(b) by 177 days.

(21) Appl. No.: 15/944,409

(22) Filed: Apr. 3, 2018

(65) Prior Publication Data

US 2018/0312306 A1 Nov. 1, 2018

Related U.S. Application Data

(60) Provisional application No. 62/490,723, filed on Apr. 27, 2017.

(51) Int. Cl.

| | |
|---|---|
| ***B65D 21/02*** | (2006.01) |
| ***B65D 51/24*** | (2006.01) |
| ***A45C 13/10*** | (2006.01) |
| ***B65D 43/02*** | (2006.01) |
| ***A45C 11/20*** | (2006.01) |

(52) U.S. Cl.

CPC ..... *B65D 43/0202* (2013.01); *A45C 11/20* (2013.01); *A45C 13/1069* (2013.01); *B65D 21/0223* (2013.01); *B65D 51/24* (2013.01); *B65D 51/249* (2013.01); *B65D 2313/04* (2013.01); *B65D 2543/00027* (2013.01); *B65D 2543/00092* (2013.01); *B65D 2543/00101* (2013.01); *B65D 2543/00203* (2013.01); *B65D 2543/00231* (2013.01); *B65D 2543/00296* (2013.01); *B65D 2543/00842* (2013.01)

(58) Field of Classification Search

CPC ..... B65D 43/0202; B65D 51/249; B65D 21/0223; B65D 51/24; B65D 2543/00101; B65D 2313/04; B65D 2543/00092; B65D 2543/00842; B65D 2543/00027; B65D 2543/00231; B65D 2543/00296; B65D 2543/00203; A45C 13/1069; A45C 11/20

USPC ..... 220/230

See application file for complete search history.

(56) References Cited

U.S. PATENT DOCUMENTS

| | | | | |
|---|---|---|---|---|
| 2,731,663 A | | 1/1956 | Thompson | |
| 5,692,617 A | * | 12/1997 | Adams | B65D 21/0223 206/501 |
| 6,886,694 B2 | | 5/2005 | McNeeley et al. | |
| 8,395,467 B2 | | 3/2013 | Fullerton et al. | |
| 8,556,095 B1 | * | 10/2013 | Yamaguchi | B65D 81/366 215/228 |

(Continued)

*Primary Examiner* — James N Smalley

(74) *Attorney, Agent, or Firm* — Jose W. Jimenez; Jimenez Law Firm

(57) ABSTRACT

There is provided a lid member for a food storage device or container, as well as a food storage system having a lid that can mate with a concave base container, which is stackable or storable via one or more magnetic devices disposed on the lid member or on each of a plurality of lid members. In a related embodiment, a magnetic device is incorporated into a floor panel of the concave base or container for ease of pairing and size matching for storage.

13 Claims, 15 Drawing Sheets

(56) References Cited

U.S. PATENT DOCUMENTS

| | | | | |
|---|---|---|---|---|
| 9,457,945 | B1 * | 10/2016 | Wang | B65D 71/70 |
| 2010/0230319 | A1 * | 9/2010 | Thomson | A47J 27/122<br>206/514 |
| 2011/0132907 | A1 * | 6/2011 | Hajichristou | B65D 43/0225<br>220/230 |
| 2014/0061199 | A1 * | 3/2014 | Dalbec | B65D 51/24<br>220/483 |
| 2014/0284225 | A1 * | 9/2014 | Davis | B44D 3/02<br>206/1.8 |
| 2017/0086580 | A1 * | 3/2017 | Conti | B65D 51/242 |
| 2017/0354292 | A1 * | 12/2017 | Caswell | A47J 36/027 |

* cited by examiner

STORAGE CONTAINER LID SYSTEM WITH ATTACHMENT DEVICE

CLAIM OF PRIORITY

This application claims priority to and the benefit of a U.S. Provisional Application with Ser. No. 62/490,723, filed on Apr. 27, 2017, which is incorporated herein by reference in its entirety.

FIELD OF THE INVENTION

The invention relates generally to a storage container lid system for improved storage and organization.

BACKGROUND

Storage containers, particularly food storage containers, which have a bowl or a concave base that defines a storage space therein typically have separate lids that can be secured over a top opening of the base to seal contents within the concave space of the container. In many instances, the lid secures to an upper or top edge or rim of the concave base to create an air tight seal for food being stored within the storage space.

One particular difficulty with such storage container systems is storing both the lids and the container bases of the storage container when the lids are not being used. Another difficulty is in storing the containers in such a way that the lids do not become lost, misplaced, or separated from the container bases, so that an appropriately-sized lid can be located when a particular container base is selected for use.

SUMMARY

In various embodiments disclosed herein, a storage container lid system is provided that facilitates stacking of the lids with each other, allows for adhering the lid to the bottom of the concave base container and allows for stacking of the base container in a vertical configuration. In one example embodiment, the invention relates generally to a container, which includes a lid member and concave base that is storable when not in use. In this example embodiment, the lid member includes an attachment device assembly that is integrated with the lid and facilitates lid stacking configurations as well as storage container stacking configurations where the concave base includes a corresponding attachment device or receptacle. In a related example embodiment, the lid member includes at least one magnet assembly that is integrated into the body of the lid member. In a related embodiment, a plurality of magnet assemblies are disposed in various locations about the lid member.

In another example embodiment, the invention relates generally to a lid assembly set or system which includes at least two lid members that can be stacked when not in use. The lid members are able to be stacked because they include an attachment device assembly in the lid member. The attachment device assembly can be integrated into one or more individual lid members. In this example embodiment, the attachment device assembly includes a magnetic assembly to facilitate adhering of a first lid member to a surface of a second lid member, also having a magnetic member or metallic member, in a stack configuration.

In yet another example embodiment, the invention relates generally to a magnetic assembly for use with a lid member of a container storage system including at least one magnetic member and an enveloping member adapted to cap the at least one magnetic member, the cap member together with the magnetic member being located in a receptacle of the lid member or on a surface of the lid member directly or molded within the lid member.

The invention advantageously provides a container, with its concave base and lid member that can be stored as a lid stack or the lid member associated with a base of a container via one or more attachment device assemblies, which provides no added clutter, or misplaced, lost or separated lids from corresponding base containers.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

The various example embodiments of the invention are generally directed at a lid member or cover accessory that is storable via one or more attachment devices, such as but not limited to magnetic assemblies, integrated or integratable into the lid member. The lid member can be a reusable, microwaveable lid member that does not generally become hot during cooking, remaining generally cool to the touch. In a related embodiment, a lid member storage system is provided herein with the advantage of being able to be stack one lid with another lid member together, or attracted towards one another, in a stacked configuration. In yet another example embodiment, the lid members described herein can also connect with an associated concave base of the container in a paired configuration when the storage container is not in use.

Figure 1A:
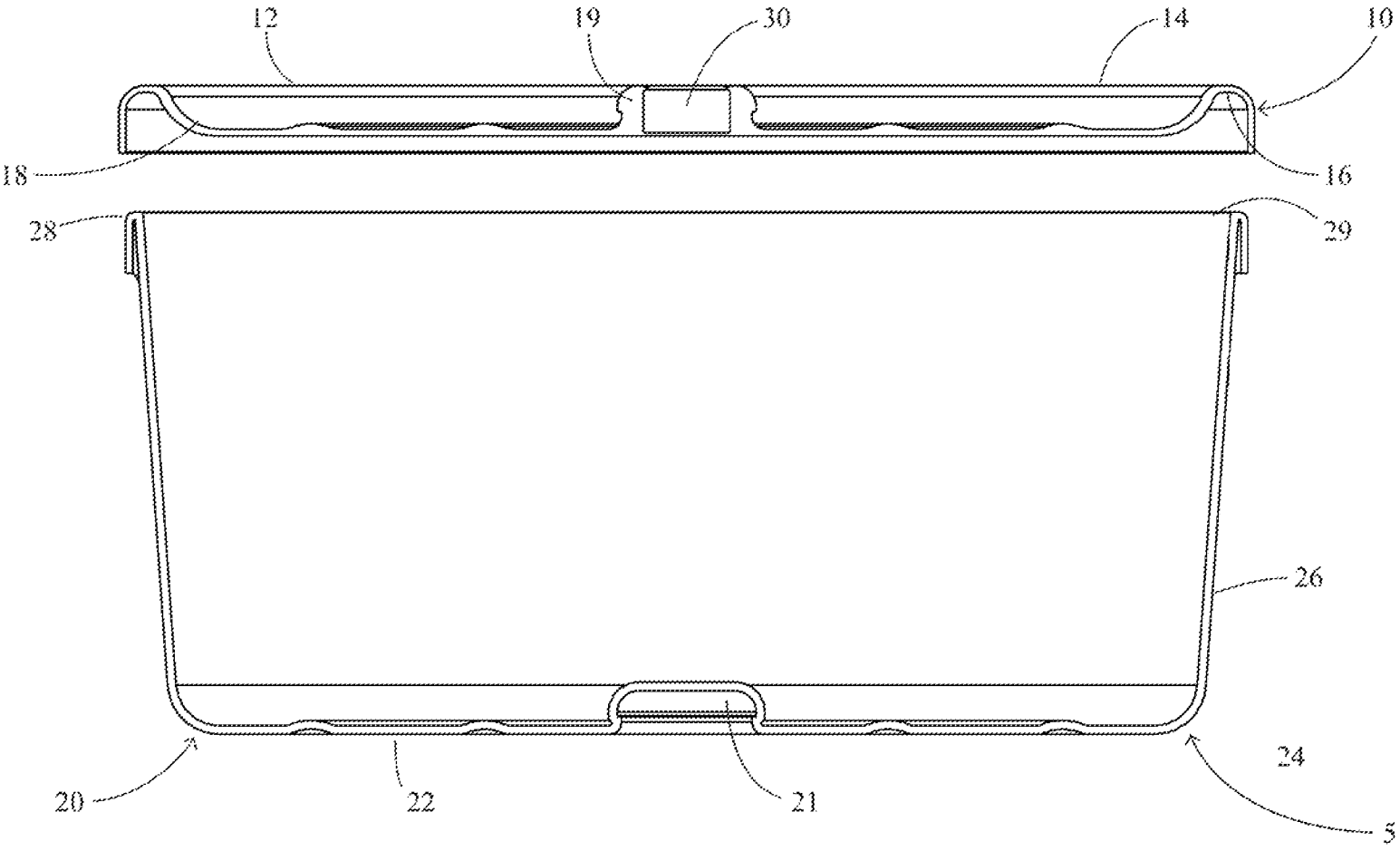
FIGS. 1A and 1B illustrate front views of a lid member with a concave base container and the lid member with the base container in a paired configuration ready for storage, respectively, according to the teachings of the invention.
Figure 1B:
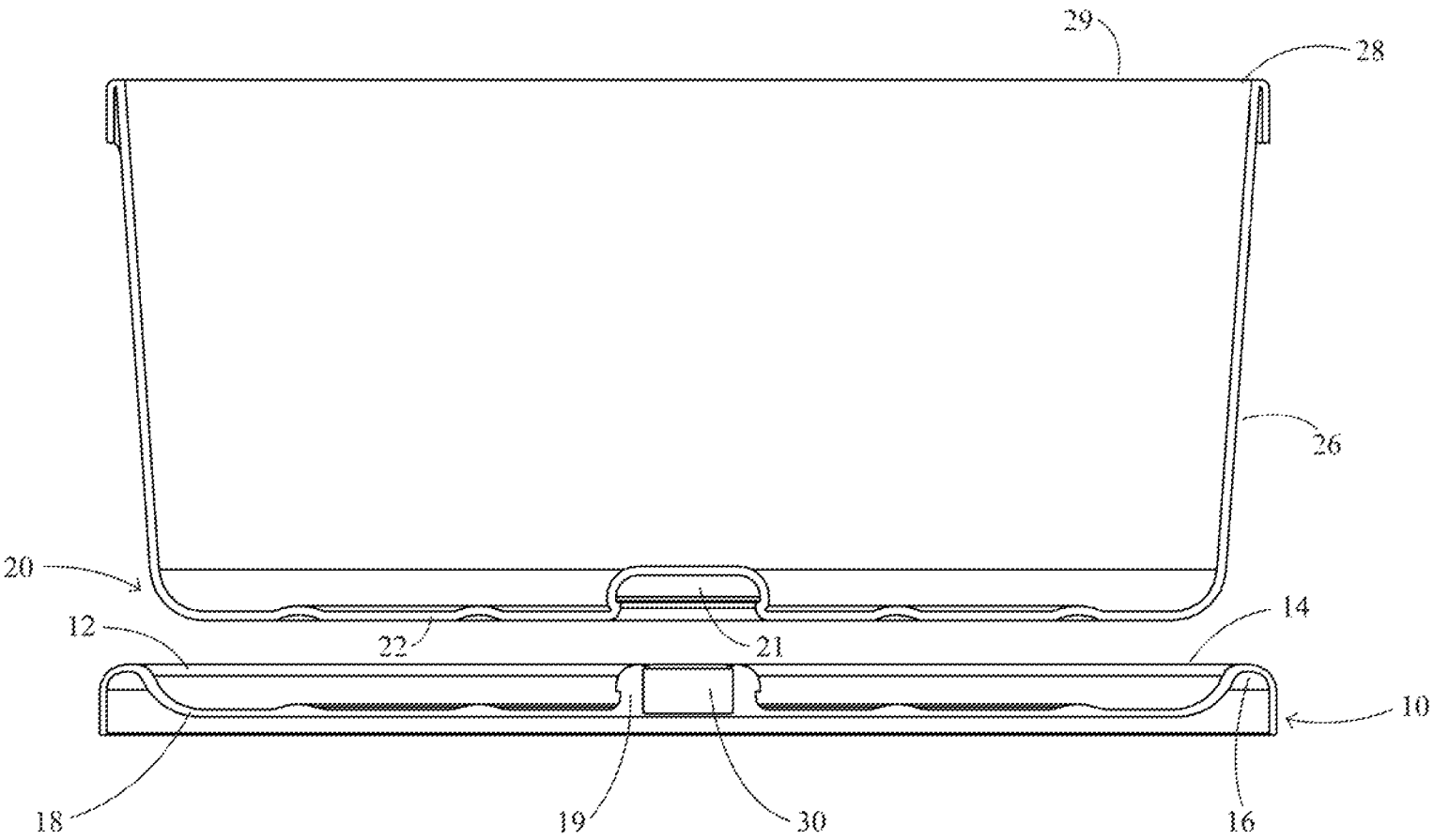
Figure 2:
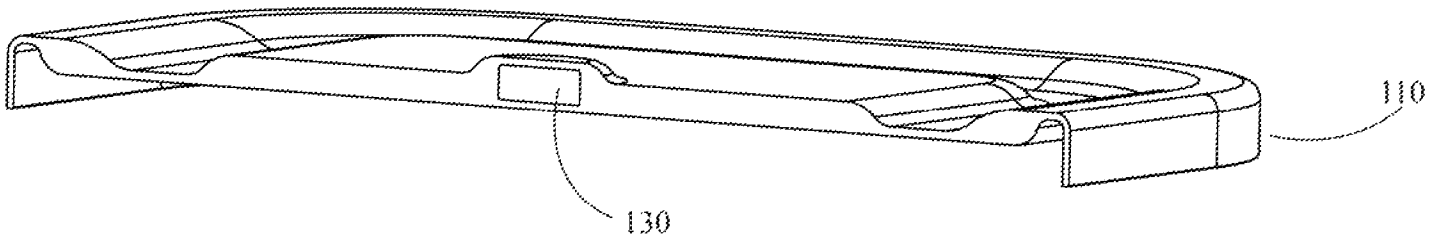
FIG. 2 illustrates a perspective sectioned view of an exemplary lid member with an attachment device assembly integrated therein according to the teachings of the invention.
Figure 3:
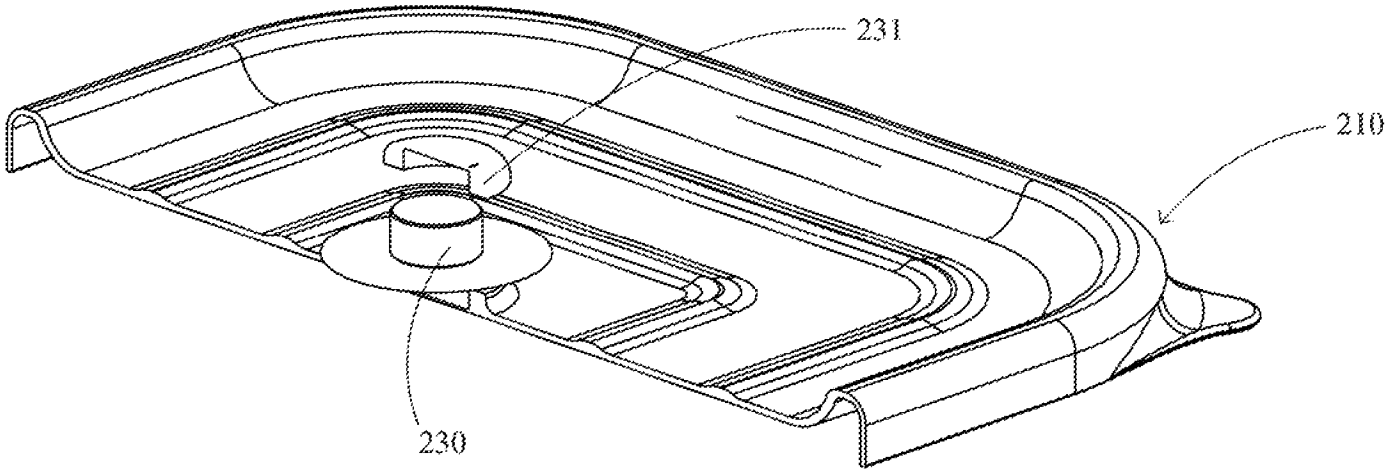
FIG. 3 illustrates an exploded, front perspective sectioned view of an exemplary lid member with an attachment device assembly according to the teachings of the invention.
Figure 4:
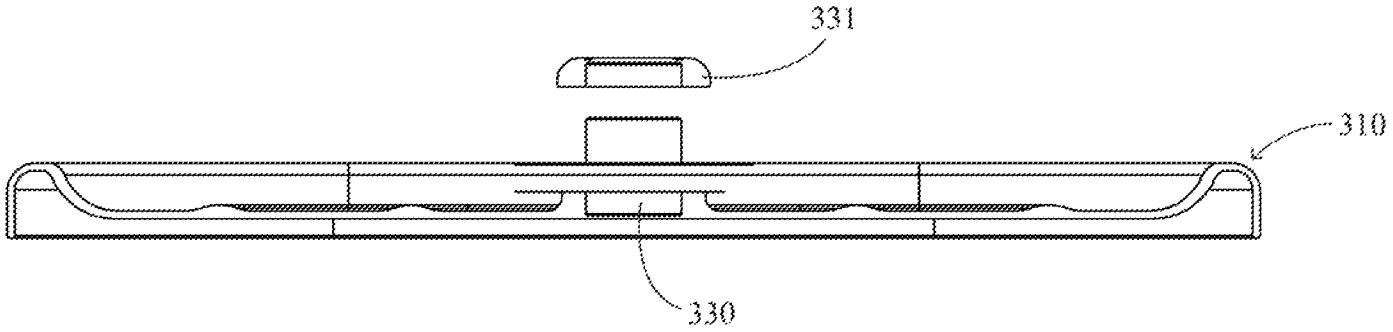
FIG. 4 illustrates an exploded, side sectioned view of an exemplary lid member with an attachment device assembly according to the teachings of the invention.

Referring now to the Figures, and in particular FIGS. 1A-1B there is illustrated a storage container system 5 and front views of a lid member 10 with a concave base 20 in a normal storage configuration and the lid member with the base container in a paired configuration ready for storage, respectively. The exemplary lid member 10 and concave base container 20 can be used for food storage. In this example embodiment, lid member 10 includes a lid panel 12, with a top surface 14, a bottom surface 16, and a perimeter collar 18 located around the top surface of the lid panel 12 and which is configured to mate with an upper rim of at least one sidewall of concave base 20. Perimeter collar 18 generally extends downward from lid panel 12 that is configured to close off the top near the upper end or rim of concave base 20. In this example embodiment, lid member 10 further includes a receptacle configuration 19 adapted for receiving at least one attachment device assembly 30. In this example embodiment, the attachment device assembly is a magnetic assembly 30. Receptacle 19 allows attachment device assembly 30 to be integrated into lid member 10.

As illustrated in FIGS. 1-5, the attachment device assembly 30 is located at the center of lid member 10 to thereby attach lid member 10 to other lid members or to the concave base when in a storage configuration. Lid member 10 can have differing shapes/sizes to cover various shaped bases and can have one or more attachment device assemblies 30 located thereon or therein (e.g. magnetic device assemblies) to facilitate lid or container storage.

In this example embodiment, concave base 20 has a base or floor panel 22, a base perimeter 24 and a side wall 26 that extend continuously around base perimeter 24 and extends upward from base perimeter 24 and base panel 22 thereby defining the container. Side wall 26 terminates at a top edge or rim 28 that defines an open top or end 29 that provides access to an interior storage space (e.g. for food). The outer surface of base floor panel 22 can include a recessed opening or aperture 21 adapted to receive a portion of a lid panel (such as receptacle 19) when the storage container set is not in use. Recessed opening or aperture 21 of concave base 20 is dimensioned to receive the top surface of lid panel 12 to facilitate stacking of lid member 10 with concave base container 20 in a paired configuration. Storage container 5 can be, but is not limited to, an injection molded plastic container and can be formed from metal, ceramic, glass or any other formable material.

In related embodiments, opening 21 of the concave base includes a magnet or a metallic member to also secure lid panel 12 to the concave base for storage or portability. In one example embodiment, receptacle 19 is configured to have a friction fit or snap-fit into opening 21 without the need for a separate attachment assembly, such as for example a magnet, to be located therein. In related embodiments, a metallic member or a magnetic member is molded into, or adhered to with other methods or means, the outer surface of base floor panel 22 to facilitate connection with a magnetic member in lid member 10. The metallic or magnet member, properly sized and shielded, should be able to be placed in a microwave for cooking of any food in the concave base.

Referring again now to FIGS. 2-4, there is illustrated a perspective sectioned view; an exploded, front perspective; an exploded, side view; and a top perspective view, respectively, of an exemplary lid member 10 that further includes at least one attachment device assembly 30 disposed within receptacle 19. In some embodiments, attachment device assembly 30 can have a top and bottom in which both halves coming together in a snap-fit configuration to form an attachment device assembly 30 (e.g. magnet assembly). In a related embodiment, one or more magnets are encased or enveloped directly into receptacle 19 as receptacle 19 is molded and formed via ultrasonic welding or other similar molding and sealing methods. In any embodiment described herein, the magnet is shielded, which includes a metal screen encasing a magnet, or a metal cap enclosure, or a metal foil wrapped around magnet, or a metal coated magnet, all which create a 'Faraday Cage' or 'Faraday Shield' effect which shields the magnet from radio frequency (RF) or electromagnetic energy or waves (e.g., microwaves). This is all performed before the magnetic element is encased into the lid member. In another embodiment, a metal member shielded in a similar manner to the magnet is used as a corresponding element in the base container to the magnet.

In yet another embodiment, a magnetic assembly 30 for use with lid member 10 is provided that includes at least one magnet member and includes an enveloping member adapted to envelop the at least one magnetic member, the enveloping member together with the magnet member is integrated with an outer surface of the lid member. In this example embodiment, the magnet member is comprised of material or alloy selected from the group consisting of neodymium, alnico, ceramic, samarium cobalt, strontium, barium and ferrite, or is a flexible strontium magnet, while the enveloping member is selected from the group consisting of a heat resistant plastic housing, a ceramic housing, a metal foil cover or coating, and a metal mesh.

Figure 5:
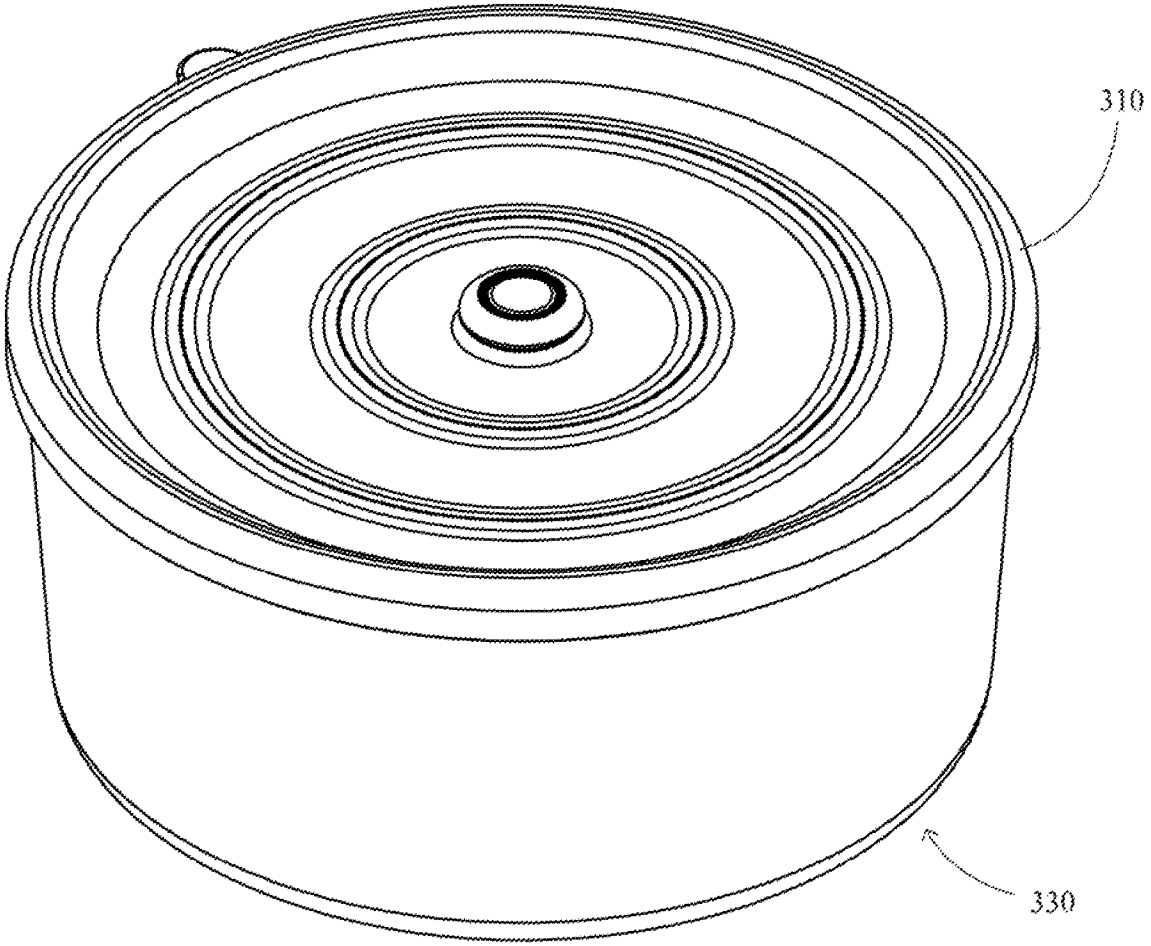
FIG. 5 illustrates a top perspective view of an exemplary storage container assembly having a lid with an attachment device assembly contained therein according to the teachings of the invention.
Figure 6:
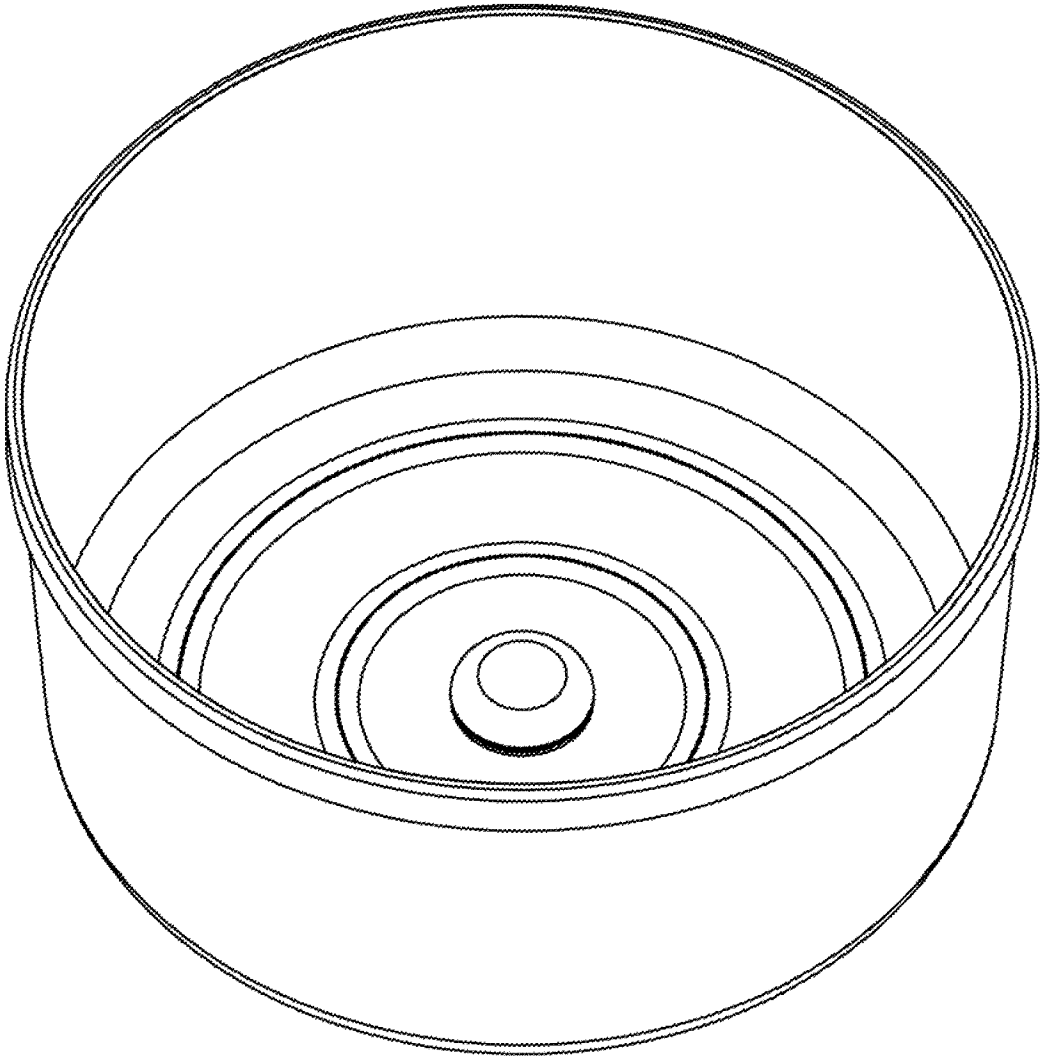
FIG. 6 illustrates a top perspective view of a concave base of FIG. 5 illustrating a floor panel construction with an exemplary receptacle according to the teachings of the invention.
Figure 7:
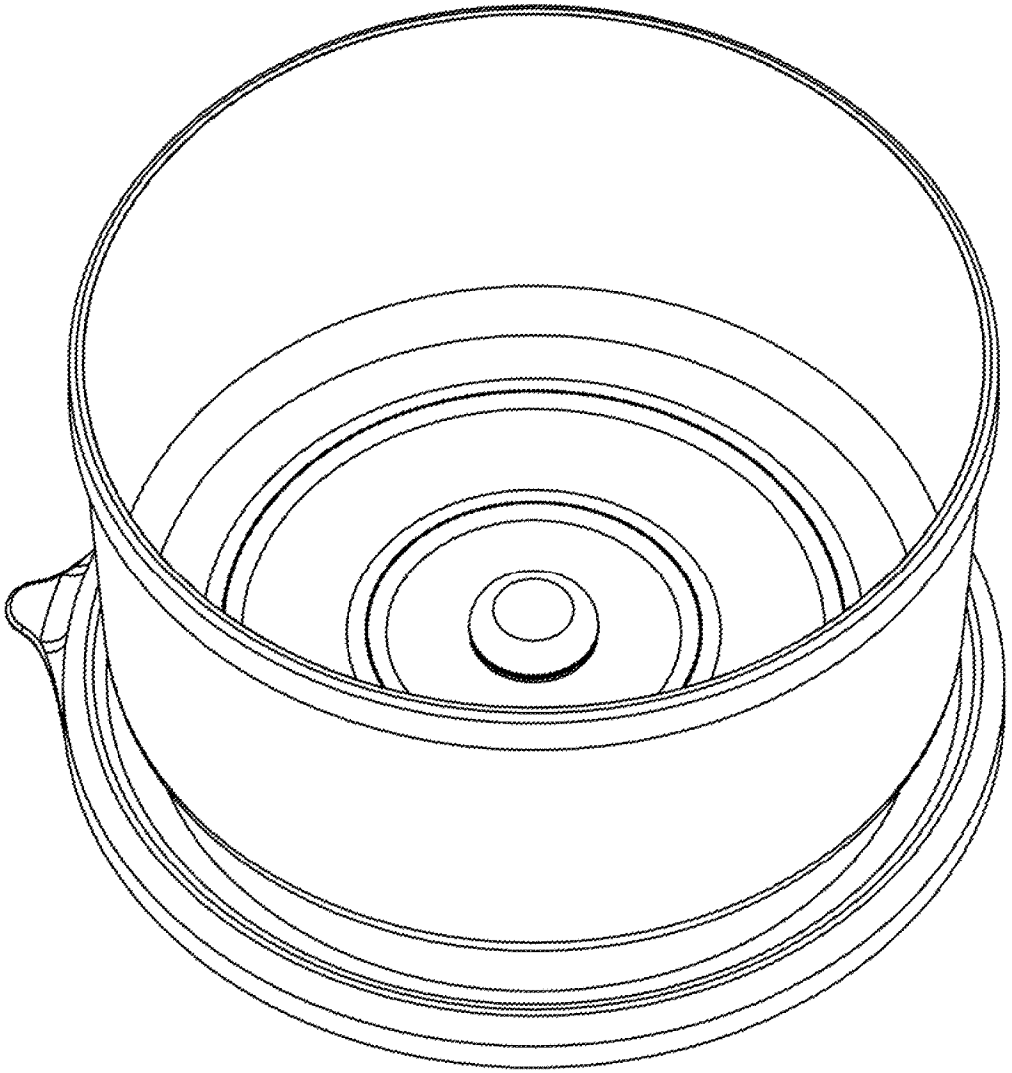
FIG. 7 illustrates a top perspective view of a lid connected underneath to a base container of FIG. 6 in a paired configuration ready for storage according to the teachings of the invention.

Referring now to FIGS. 5-10, there are illustrated other embodiments of the storage system similar to FIGS. 1-4. In particular, FIG. 5 illustrates a top perspective view of an exemplary circular storage container assembly having a lid with an attachment device assembly contained therein according to the teachings of the invention. FIG. 6 illustrates a top perspective view of a concave base of FIG. 5 illustrating a floor panel construction with an exemplary receptacle according to the teachings of the invention. FIG. 7 illustrates a top perspective view of a lid connected underneath to a base container of FIG. 6 in a paired configuration ready for storage according to the teachings of the invention.

Figure 8:
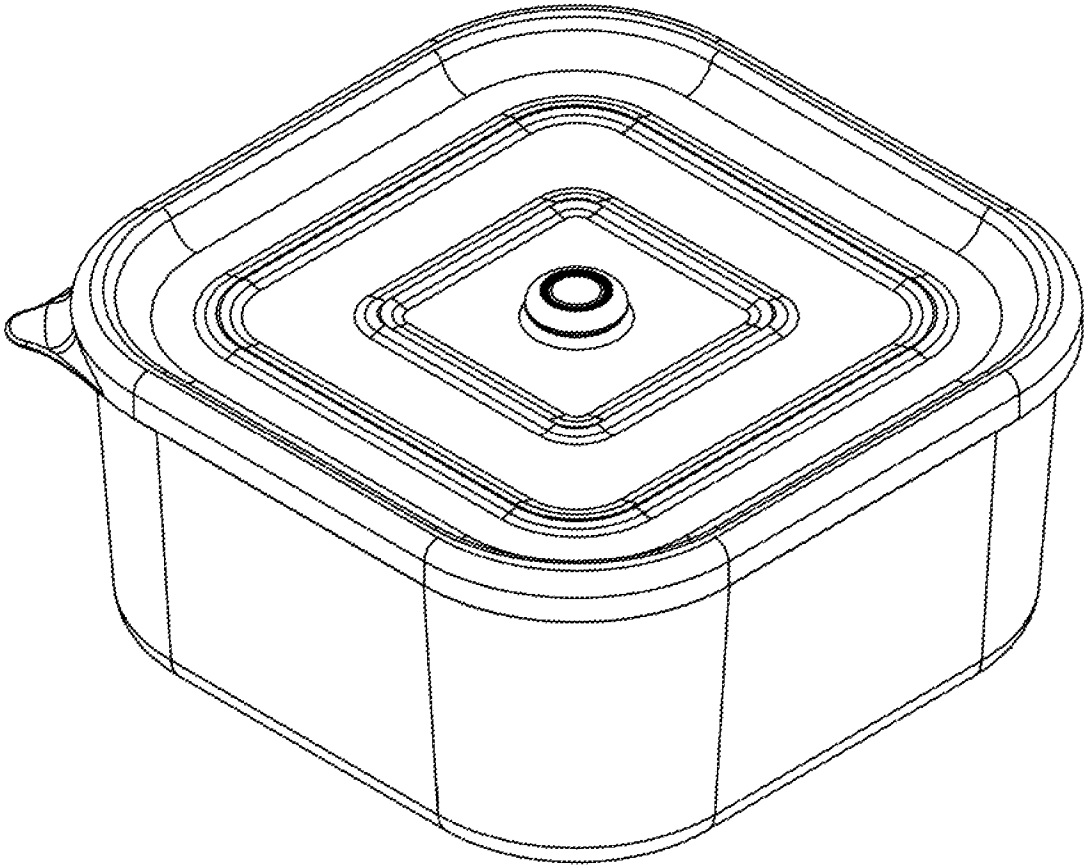
FIG. 8 illustrates a perspective view of another exemplary storage container assembly having a lid with an attachment device assembly contained therein according to the teachings of the invention.
Figure 9:
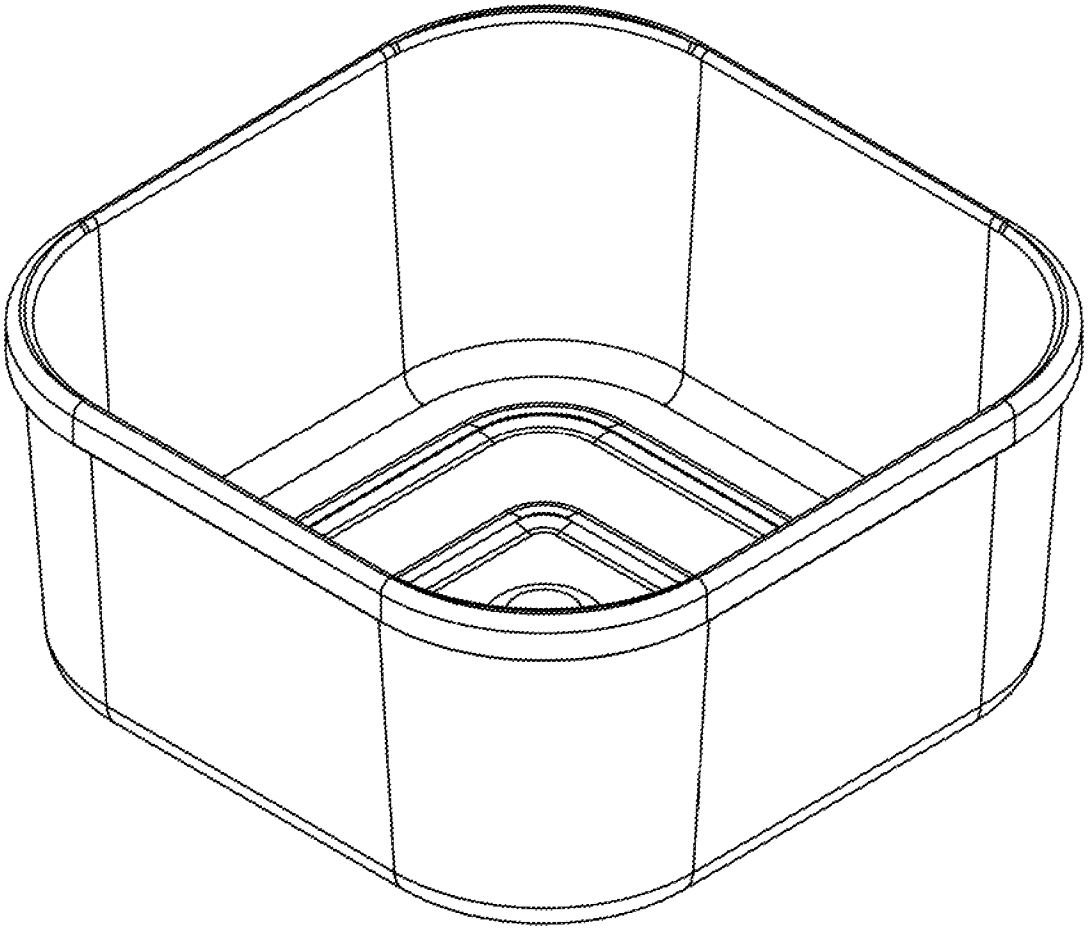
FIG. 9 illustrates a top perspective view of the concave base of FIG. 8 illustrating a floor panel construction with an exemplary receptacle according to the teachings of the invention.
Figure 10:
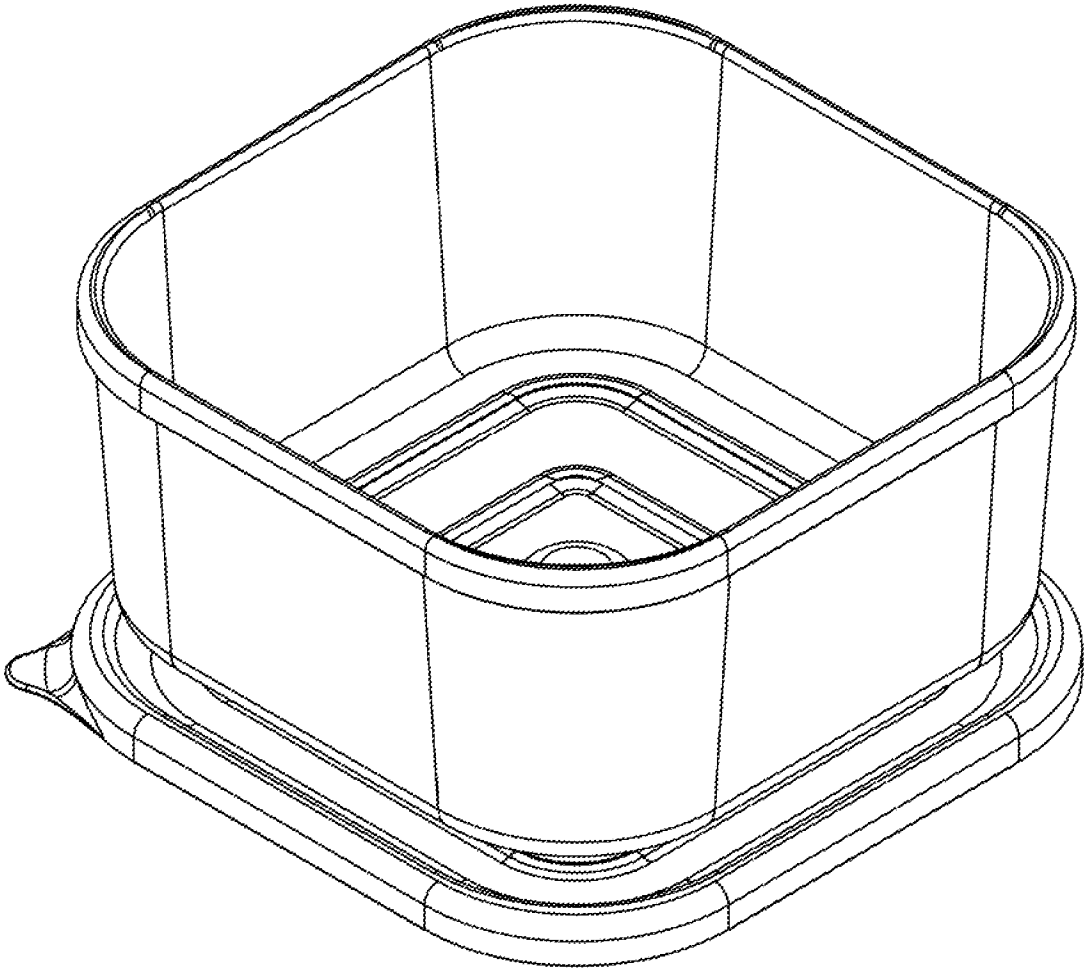
FIG. 10 illustrates a perspective view of a lid connected underneath to a base container of FIG. 8 in a paired configuration ready for storage according to the teachings of the invention.

Referring now to FIGS. 8-10, there is illustrated another storage system having a rectangular or square configuration. In particular, FIG. 8 illustrates a perspective view of another exemplary storage container assembly and having a lid with an attachment device assembly contained therein according to the teachings of the invention. FIG. 9 illustrates a top perspective view of the concave base of FIG. 8 illustrating a floor panel construction with an exemplary receptacle according to the teachings of the invention. FIG. 10 illustrates a perspective view of a lid connected underneath to a base container of FIG. 8 in a paired configuration ready for storage according to the teachings of the invention.

Figure 11A:
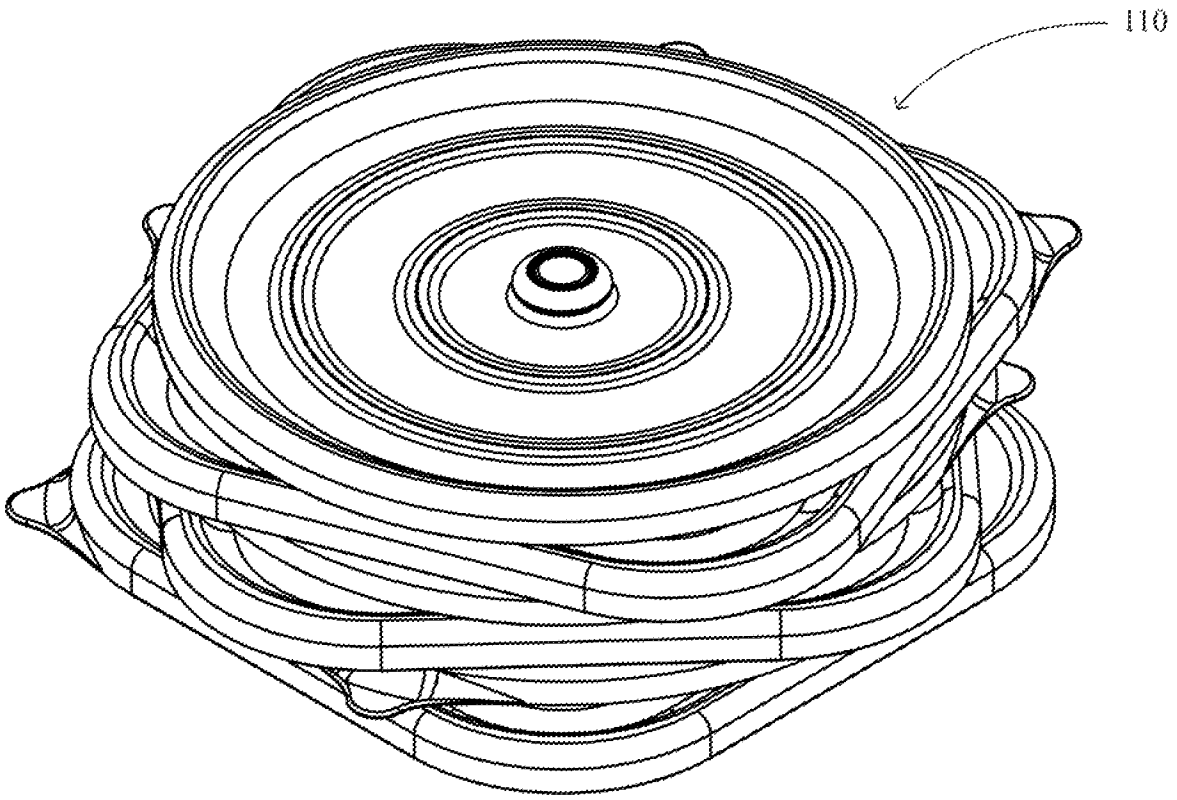
FIGS. 11A-11C illustrate an exemplary perspective, side and top views of an organized lid stack in a vertical and horizontal configuration, respectively, facilitated by an attachment device assembly as described herein according to the teachings of the invention.
Figure 11B:
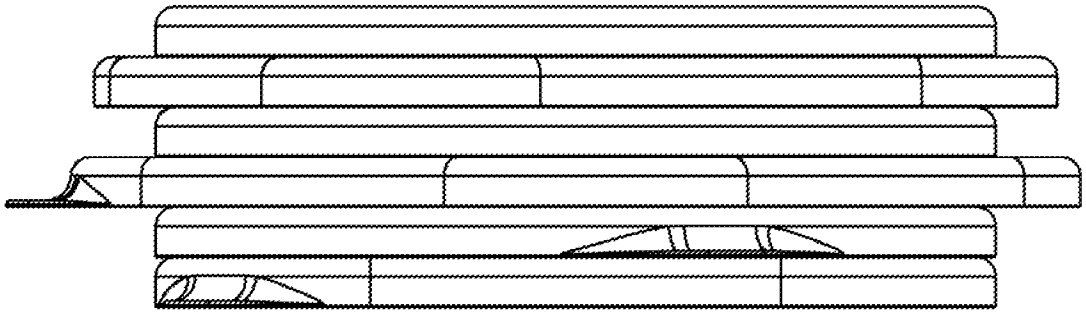
Figure 11C:
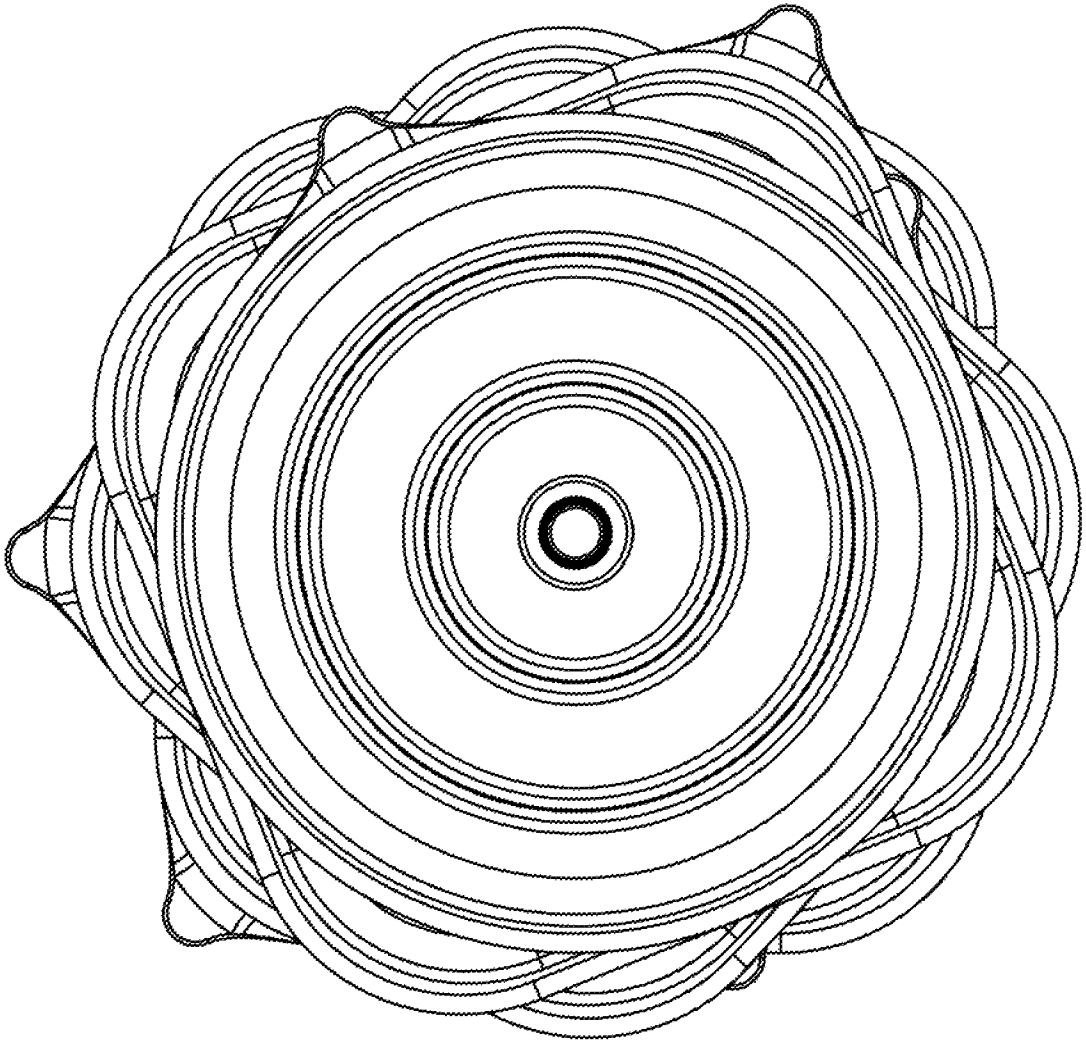

With respect to FIGS. 11A-11C, there are illustrated perspective, side and top views of a plurality of stacked lids according to the teachings and benefits of the invention. In particular, where each of the lids 110 are nested or stacked with one another to form an organized lid stack, the benefits of the magnetic-oriented attachment assembly are clearly evident. Different sized and shaped lids may be quickly stacked when the lids are not in use. The plurality of stacked lids can be further nested or stacked on the underside of a base container or a plurality of base containers when the containers and lids are not in use. Lid 110 is also associated with its corresponding concave base when the container is not in use.

Figure 12:
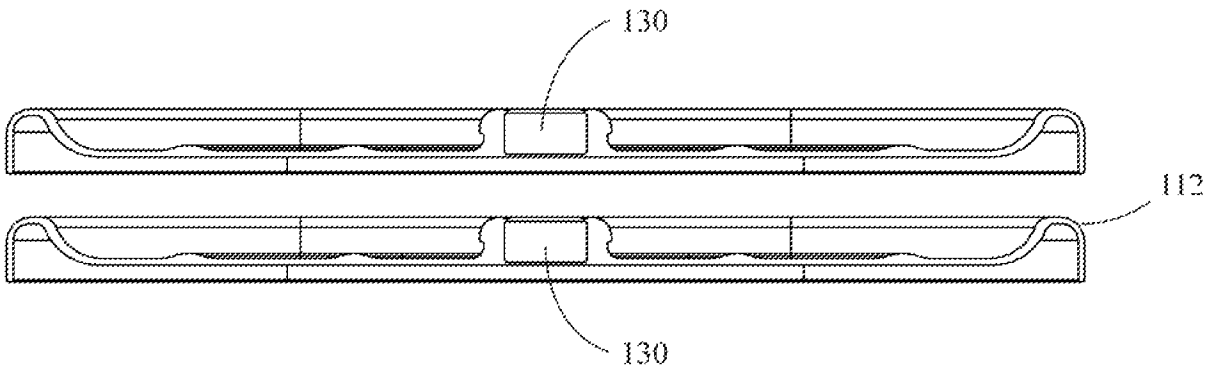
FIG. 12 illustrates a cross section cutaway view of at least two stacked lids according to the teachings of the invention.

With respect to FIG. 12 there is illustrated a side view in cross section of a plurality of stacked lids according to the invention. In this example embodiment, the lids are aligned with an attachment device assembly 130 and are aligned such that lid panels 112 are also vertically aligned. In related embodiments, the shape of the lid member includes square, round, oval, and rectangular and is not limited to the shapes as illustrated. (See FIGS. 5-10). In addition, in related embodiments, the material of the lid member is not limited to plastic and includes other materials such as microwave and standard oven safe materials such as metal, glass, aluminum, cardboard, ceramic and silicone. Attachment assemblies are not just limited to microwave-safe and electromagnetically-safe magnets and include, but are not limited to, suction cups, mechanical fasteners (such as hook and loop fasteners or snap buttons) or twist-on or screw on fasteners and light adhesives that are microwave and heat resistant.

U.S. Pat. Nos. 2,731,663; 6,886,694 and 8,395,467 are incorporated herein by reference in their entireties.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A microwavable storage container system comprising:

a concave base having a floor panel with an interior surface, an outer surface, the concave base floor panel having at least one sidewall extending generally upward from the floor panel and about the perimeter of the floor panel, wherein a magnetic assembly is integrated into the concave base floor panel; and a microwavable lid member adapted to cover the concave base, the lid member having a lid panel with a top surface, a bottom surface, and a perimeter collar around the top surface of the lid panel, the perimeter collar adapted to mate with an upper rim of the at least one sidewall of the concave base, the lid member further including a receptacle adapted to receive an attachment device assembly, wherein the attachment device assembly includes a magnetic assembly, and wherein the magnetic assembly includes a magnet and an enveloping member, the enveloping member further including one of a metal foil or metallic coating adapted to shield the magnet during microwave cooking.

2. The container system according to claim 1, wherein the outer surface of the floor panel of the concave base includes a recessed opening or aperture adapted to receive a portion of a lid member when the container is not in use or when in a stacked configuration.

3. The container system according to claim 1, wherein the magnetic assembly comprises a cap member configured to enclose the magnet within the receptacle of the lid member.

4. The container system according to claim 1, wherein the magnetic assembly comprises at least one magnet member configured to be integrated into the top surface of the lid member.

5. The magnetic assembly according to claim 1, wherein the magnetic member is comprised of material selected from the group consisting of neodymium, alnico, ceramic, samarium cobalt, strontium, barium and ferrite or is a flexible strontium magnet member.

6. The storage container system according to claim 1, wherein the attachment device assembly comprises a mechanical fastener device to facilitate adhering of the lid member to the concave base.

7. The storage container system according to claim 1, wherein the attachment device assembly is selected from the group consisting of a friction fit structure, a snap-fit configuration, a hook and loop fastener, a suction cup fastener, a twist-on or screw-in configuration and a light adhesive portion disposed on the lid member.

8. A microwavable lid member assembly storage system comprising:

a first lid member and a second lid member, each lid member having a lid panel with a top surface, a bottom surface, and a perimeter collar around the top surface of the lid panel, the perimeter collar of each of the lid members adapted to mate with an upper rim of the at least one sidewall of a concave base, wherein each of the first and second lid members further include a receptacle adapted to receive an attachment device assembly, wherein the attachment device assembly facilitates adherence of the first lid member to the second lid member in a stack configuration, wherein the attachment device assembly comprises a magnetic assembly which facilitates adherence of the first lid member to the second lid member in the stack configuration; and wherein the magnetic assembly includes a magnet and an enveloping member, the enveloping member further including one of a metal foil or metallic coating adapted to shield the magnet during microwave cooking.

9. The lid member storage system according to claim 8, wherein the magnetic assembly comprises a cap member that encapsulates the magnetic assembly within the receptacle.

10. The lid member storage system according to claim 8, wherein the attachment device assembly comprises a mechanical fastener device to facilitate adhering of the first lid member to the second lid member in the stack configuration.

11. The lid member and storage system according to claim 9, wherein the cap member is selected from the group consisting of one or more of the following materials: plastic, silicone, and/or metal mesh.

12. The lid member and storage system according to claim 8, wherein the attachment device assembly is selected from the group consisting of a friction fit structure, a snap-fit configuration, a hook and loop fastener, a suction cup fastener, a twist-on or screw-in configuration and a light adhesive portion disposed on the lid member.

13. The magnetic assembly according to claim 8 wherein the magnet is comprised of material selected from the group consisting of neodymium, alnico, ceramic, samarium cobalt, strontium, barium and ferrite or is a flexible strontium magnet member.

* * * * *